US007138189B2

(12) United States Patent
Narita et al.

(10) Patent No.: US 7,138,189 B2
(45) Date of Patent: Nov. 21, 2006

(54) HEAT-RESISTANT TI ALLOY MATERIAL EXCELLENT IN RESISTANCE TO CORROSION AT HIGH TEMPERATURE AND TO OXIDATION

(75) Inventors: Toshio Narita, Hokkaido (JP); Takumi Nishimoto, Hokkaido (JP)

(73) Assignee: Japan Science and Technology Agency, Saitama (JP)

( * ) Notice: Subject to any disclaimer, the term of this patent is extended or adjusted under 35 U.S.C. 154(b) by 0 days.

(21) Appl. No.: 10/509,028

(22) PCT Filed: Mar. 25, 2003

(86) PCT No.: PCT/JP03/03664

§ 371 (c)(1),
(2), (4) Date: May 16, 2005

(87) PCT Pub. No.: WO03/080888

PCT Pub. Date: Oct. 2, 2003

(65) Prior Publication Data

US 2005/0244668 A1 Nov. 3, 2005

(30) Foreign Application Priority Data

Mar. 27, 2002 (JP) ..... 2002-087738

(51) Int. Cl.
*B32B 15/00* (2006.01)
*C22C 14/00* (2006.01)
*C23C 10/38* (2006.01)
*C23C 10/58* (2006.01)

(52) U.S. Cl. ..... 428/651; 428/660; 148/527; 427/252; 427/255.7; 427/405

(58) Field of Classification Search ..... 428/660; 427/252

See application file for complete search history.

(56) References Cited

U.S. PATENT DOCUMENTS 5,785,775 A * 7/1998 Smashey et al. ..... 148/669

FOREIGN PATENT DOCUMENTS

EP 0696649 4/1999

(Continued)

OTHER PUBLICATIONS

Chungen Zhou et al.; ELSEVIER, Surface and Coatings Technology 132, pp. 117-123, 2000. Cited in the specification.

*Primary Examiner*—John J. Zimmerman
(74) *Attorney, Agent, or Firm*—Westerman, Hattori, Daniels & Adrian, LLP.

(57) ABSTRACT

Disclosed is a heat-resistant Ti alloy material excellent in high-temperature corrosion resistance and oxidation resistance, which comprises a base made of a heat-resistant Ti alloy and a surface layer formed on the surface of the base. The surface layer has a multilayer structure including an inner layer and an outer layer. The inner layer has three coexistent phases consisting of a β phase, a γ phase and a Laves phase in the phase diagram of a Ti—Al—Cr based alloy, and the outer layer is made of an Al—Ti—Cr based alloy having an Al concentration of 50 atomic % or more. The heat-resistant Ti alloy material is produced by subjecting a substrate made of a heat-resistant Ti alloy to a Cr diffusion treatment at a temperature within a β single-phase region in the phase diagram of a Ti—Al—Cr based alloy, precipitating a γ phase and a Laves phase from the β phase during a cooling process to form the inner layer with three coexistent phases consisting of the β, γ and Laves phases, and then subjecting the obtained product to an Al diffusion treatment to form the outer layer. The heat-resistant Ti alloy material can prevent the diffusion of Al from the outer layer to the base and the diffusion of elements of the base to the outer layer while forming a protective $Al_2O_3$ film in a self-repairing manner, to provide excellent high-temperature corrosion resistance and oxidation resistance to the heat-resistant Ti alloy base.

6 Claims, 5 Drawing Sheets

FOREIGN PATENT DOCUMENTS

| | | | |
|---|---|---|---|
| EP | 0863223 | | 7/2001 |
| JP | 5-156423 | | 6/1993 |
| JP | 05-156423 A | * | 6/1993 |
| JP | 5-320791 | | 12/1993 |
| JP | 6-93412 | | 4/1994 |
| JP | 9-324256 | | 12/1997 |

* cited by examiner

Al DIFFUSION AT 1300°C

Al DIFFUSION AT 1200°C

Al DIFFUSION AT 1100°C

Al DIFFUSION AT 1000°C

HEAT-RESISTANT TI ALLOY MATERIAL EXCELLENT IN RESISTANCE TO CORROSION AT HIGH TEMPERATURE AND TO OXIDATION

TECHNICAL FIELD

The present invention relates to a heat-resistant Ti alloy material excellent in high-temperature corrosion resistance and oxidation resistance, which comprises a base made of a heat-resistant Ti alloy and a protective layer formed on the surface of the base in the form of a multilayer structure capable of forming a protective $Al_2O_3$ film in a self-healing or self-repairing manner.

BACKGROUND ART

A structural material for use in turbochargers, jet engines, gas turbines, space planes or the like, which is to be exposed to high-temperature atmospheres, includes heat-resistant Ti alloys, such as TiAl based intermetallic compounds [$Ti_3Al$ ($\alpha_2$ phase) and TiAl ($\gamma$ phase)] and high-temperature titanium alloys [$\alpha+\beta$ type: Ti-6Al-4V alloy, Ti-6Al-4Mo-4Cr (incl. Zn, Sn) alloy; near $\alpha$ type: Ti-6Al-4Zr-2.8Sn alloy; near $\beta$ type: Ti-5Al-3Mo-3Cr-4Zr-2Sn alloy]; superalloys, such as Ni-based, Co-based and Fe-based heat-resistant alloys; other heat-resistant alloys, such as Nb-based, Ir-based and Re-based heat-resistant alloys; carbon materials; and other various intermetallic compounds.

It is often the case that a high-temperature atmosphere in contact with the heat-resistant alloy material contains an oxidative or corrosive substance, such as oxygen or water vapor. If the heat-resistant alloy material is exposed to a corrosive high-temperature atmosphere, the reaction between the alloy material and the corrosive substance in the atmosphere will be liable to cause accelerated oxidation and/or high-temperature corrosion in the alloy material. It is also likely that O, N, S, Cl and/or C diffusing from the atmosphere into the heat-resistant alloy material causes internal corrosion in the surface of the heat-resistant alloy material, which leads to deterioration in material strength.

Such high-temperature corrosion can be prevented by covering the surface of the heat-resistant alloy material with a protective film excellent in environment blocking performance. The protective film is typically made of $Al_2O_3$, $SiO_2$ or $Cr_2O_3$, and formed by diffusing Al, Si or Cr from a base to a surface layer of a heat-resistant alloy material in an oxidizing atmosphere (see, for example, the following Patent Publications 1 to 3 and Non-Patent Publication 1) or by depositing $Al_2O_3$, $SiO_2$ or $Cr_2O_3$ on the surface of a heat-resistant alloy material through a CVD process, a thermal spraying process, a reactive sputtering process or the like. The $Al_2O_3$, $SiO_2$ or $Cr_2O_3$ film can suppress the reaction between the oxidative substance in the atmosphere and the metal elements of the heat-resistant alloy material to maintain excellent high-temperature characteristics inherent in the heat-resistant alloy.

Patent Publication 1: Japanese Patent Laid-Open Publication No. 05-156423 (U.S. Pat. No. 2,948,004)

Patent Publication 2: Japanese Patent Laid-Open Publication No. 06-093412 (U.S. Pat. No. 2,922,346)

Patent Publication 3: Japanese Patent Laid-Open Publication No. 09-324256

Non-Patent Publication 1: C. Zhou, H. Xu, S. Gong, Y Yang and K.-Y. Kim; Surface and Coating Technology 132 (2000), p. 117.

DISCLOSURE OF INVENTION

In the aforementioned method of diffusing Al from a heat-resistant alloy base to a surface layer to form an $Al_2O_3$ film, Al in the surface of the heat-resistant alloy base is consumed by the film formation to create a layer with a reduced Al concentration (Al-depleted layer) in the surface of the heat-resistant alloy base immediately below the $Al_2O_3$ film.

The Al-depleted layer cannot serve as an Al source required for forming the $Al_2O_3$ film any more. Thus, if a defect, such as crack or peeling, occurs in the $Al_2O_3$ film on the surface of the heat-resistant alloy material, a sufficient amount of Al cannot be supplied from the heat-resistant alloy base, and corrosion and/or oxidation developing from the defective portion will acceleratedly spread over the surface.

It is conceivable that the content of Al in the heat-resistant alloy base is preset at a higher value in consideration of the reduction of the Al concentration caused by the creation of the Al-depleted layer in the surface of the heat-resistant alloy base, so as to maintain the environment blocking performance of the $Al_2O_3$ film over a long period of time. However, a higher content of Al will accelerate embrittlement in the heat-resistant alloy base to cause difficulties in working, such as forging or shaping, of the heat-resistant alloy material. Moreover, the higher content of Al causes deteriorated high-temperature strength in some types of heat-resistant alloy bases.

In the aforementioned heat-resistant Ti alloys, it is described that a protective $Al_2O_3$ scale can be formed only if they have an Al concentration of 50 atomic % or more in oxygen gas atmosphere, and an Al concentration of 55 atomic % or more in the air. In particular, it is important to prevent the formation of titanium oxides, because atmospheres encountering in practical circumstances contain corrosive gases, such as nitrogen, water vapor or sulfur dioxide, in addition to oxygen. That is, it is required to achieve the reduction in Ti concentration as well as the increase in Al concentration.

The inventors found that a three-phase layer film with coexistent $\beta$, $\gamma$ and Laves phases in the phase diagram of a Ti—Al—Cr based alloy, which is formed as an inner layer having a high diffusion barrier function, can prevent the diffusion of Al from a protective layer to a heat-resistant Ti alloy base and the diffusion of the elements of the base to an outer layer while forming a protective $Al_2O_3$ film in a self-healing or self-repairing manner, so as to provide excellent high-temperature corrosion resistance and oxidation resistance to the heat-resistant Ti alloy base.

Specifically, the present invention provides a heat-resistant Ti alloy material excellent in high-temperature corrosion resistance and oxidation resistance, which comprises a base made of a heat-resistant Ti alloy and a surface layer formed on the surface of the base. The surface layer has a multilayer structure including an inner layer and an outer layer. The inner layer has three coexistent phases consisting of a $\beta$ phase, a $\gamma$ phase and a Laves phase in the phase diagram of a Ti—Al—Cr based alloy, and the outer layer is made of an Al—Ti—Cr based alloy having an Al concentration of 50 atomic % or more.

In the heat-resistant Ti alloy material of the present invention, the outer layer may include at least one phase selected from the group consisting of a Ti $(Al, Cr)_3$ phase, a Ti $(Al, Cr)_2$ phase and a $\tau$ phase.

The above heat-resistant Ti alloy material may further include a Cr diffusion layer interposed between the base and the inner layer.

The present invention also provides a method for producing the above heat-resistant Ti alloy material. The method comprises subjecting a substrate made of a heat-resistant Ti alloy to a Cr diffusion treatment to diffuse chromium into the substrate at a temperature within a β single-phase region in the phase diagram of a Ti—Al—Cr based alloy, precipitating a γ phase and a Laves phase from the β phase during a cooling process to form the inner layer with three coexistent phases consisting of the β, γ and Laves phases, and then subjecting the obtained product to an Al diffusion treatment to diffuse aluminum into the product so as to form the outer layer of an Al—Ti—Cr based alloy having an Al concentration of 50 atomic % or more.

The method of the present invention may further include performing a heat treatment during the cooling process.

In the method of the present invention, the Cr diffusion treatment may be performed at a temperature of 1300° C. or more within the β single-phase region, and the Al diffusion treatment may be performed at a temperature of 1200° C. or less.

The inner layer in the multilayer structure is formed by diffusing Cr into the heat-resistant Ti alloy substrate in a high-temperature range providing a β single phase, and then precipitating a γ phase and a Laves phase from the β single phase during a cooling process to separate three phases consisting of the β, γ and Laves phases.

Then, when the outer layer is formed through an Al vapor diffusion treatment at a high-temperature, a protective film excellent in high-temperature corrosion resistance and oxidation resistance will be formed on the surface of the outer layer or the surface of the surface heat-resistant Ti alloy material.

Instead of the Al vapor diffusion treatment, the outer layer may be formed by depositing an Al coating layer on the substrate through a plating process using a molten-salt bath, an electroplating process using a nonaqueous bath, a CVD process, a PVD process or a sputtering process, and then subjecting the substrate with the deposited layer to a heat treatment to diffuse Al into the substrate.

(Function)

In conventional heat-resistant alloy materials, the diffusion coefficient of a diffusion barrier layer has been selectively set at a relatively small value. By contrast, as shown in FIG. 1*a*, in the heat-resistant Ti alloy material of the present invention, a protective layer with a multilayer structure comprising a three-phase layer (inner layer 1) which consists of Ti—Al—Cr based β, γ and Laves phases and a layer (outer layer 2) which includes at least one phase selected from the group consisting of a Ti $(Al, Cr)_3$ phase, a Ti $(Al, Cr)_2$ phase and a τ phase and has a high Al concentration is formed on the surface of a base 3.

The three-phase layer with β, γ and Laves phases is formed by diffusing Cr into a substrate in a high-temperature range providing a β single phase (about 1300° C. in case where the substrate is made of a Ti—Al—Cr based alloy), and then controlling a cooling rate or isothermally holding during a cooling process to separate γ and Laves phases from the β single phase by means of phase transformation.

The three-phase layer or inner layer serves as a diffusion barrier layer, and has an additional function of relaxing the thermal stress of the outer layer 2 to suppress the occurrence of cracks. Further, a Cr diffusion layer (see FIGS. 1*a* and 1*b*) remains at the interface between the inner layer 1 and the base 3 in some cases. In this case, the Cr diffusion layer also serves as a stress relaxation layer.

The three-phase layer with Ti—Al—Cr based β, γ and Laves phases serves as an excellent diffusion barrier layer to prevent the diffusion of Al from the outer layer 2 to the base 3 and the diffusion of the elements of the base 3 to the outer layer 2. In the Ti—Al—Cr based three-phase layer, the respective elements contained in each of the phases have the same chemical potential, and thereby there is no chemical potential gradient required as a driving force for inducing the diffusion of Ti, Al and Cr in the three-phase layer. Thus, no diffusion occurs therein.

More specifically, when three phases in a Ti—Al—Cr based ternary alloy coexist under the condition of a constant temperature and pressure, the respective elements in each of the phases have the same activity while the phases are different in concentration. In principle, the transfer of an element is not dependent on concentration but on activity gradient. Therefore, if there is no difference in activity, any mass transfer or diffusion will not occur.

For example, in case where a three-phase layer is formed in a Ti—Al alloy, the outer layer 2 with a high Al concentration is formed on the base 3 through the three-phase layer with β, γ and Laves phases. Thus, the three-phase layer can prevent the diffusion of Al from the outer layer 2 with a high Al concentration to the base 3 to maintain the Al concentration of the outer layer 2 in the high initial level.

Therefore, even if a protective $Al_2O_3$ film created by the reaction between the outer layer and oxygen in atmosphere has a defect, Al required for the formation of $Al_2O_3$ will be supplied from the outer layer 2 to allow the defective portion of the $Al_2O_3$ film to be self-repaired. This can suppress the occurrence of high-temperature corrosion and/or abnormal oxidation to maintain the excellent high-temperature characteristics inherent in the heat-resistant alloy over a long period of time.

While the formation of a film or layer generally causes significant deterioration in strength of a heat-resistant alloy material, the production method of the present invention may additionally perform a heat treatment during the cooling process from the β single-phase region to control the distribution and mode of the three phases so as to provide improved mechanical properties thereof. The three-phase mixed layer capable of being structurally controlled by the cooling rate and the heat treatment contributes to improvement in mechanical characteristic of the heat-resistant alloy material. In view of this feature, the Ti—Al—Cr based three-phase mixed layer also serves as an excellent diffusion barrier layer.

BEST MODE FOR CARRYING OUT THE INVENTION

Figure 1A:
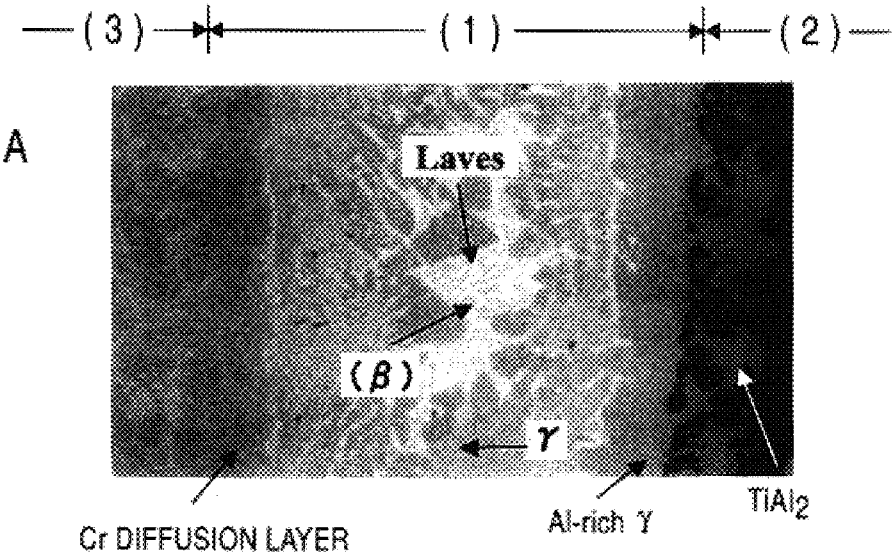
FIG. 1*a* is a metallographic micrograph showing the section of a surface region of a heat-resistant Ti alloy material in which a protective layer with a multilayer structure having an inner layer 1 and an out layer 2 is formed on the surface of a base 3.

A substrate for use in a heat-resistant Ti alloy material of the present invention includes heat-resistant Ti alloys, such as TiAl based intermetallic compounds [$Ti_3Al$ ($\alpha_2$ phase) and TiAl ($\gamma$ phase)] and high-temperature titanium alloys [$\alpha+\beta$ type: Ti-6Al-4V alloy, Ti-6Al-4Mo-4Cr (incl. Zn, Sn) alloy; near $\alpha$ type: Ti-6Al-4Zr-2.8Sn alloy; near $\beta$ type: Ti-5Al-3Mo-3Cr-4Zr-2Sn alloy].

The heat-resistant Ti alloy is typically a Ti—Al based alloy or a Ti—Al intermetallic compound, which is generally a multi-component alloy containing one or more elements of Cr, V, Nb, Mo, Fe, Si, Ta, W, B and Ag. These elements are contained in the range of several atomic % to about 10 atomic %. While a surface layer with a multilayer structure having an inner layer 1 and an outer layer 2 contains Al, Cr and Ti as primary elements, another element of the alloy substrate can be contained therein in just a slight amount.

In advance of a Cr diffusion treatment, the heat-resistant Ti alloy substrate is subjected to a pretreatment, such as polishing using a water-resistant abrasive paper or sandblasting. Then, the heat-resistant Ti alloy substrate is subjected to the Cr diffusion treatment to diffuse Cr into the substrate in a high-temperature range providing a $\beta$ single phase. More specifically, in case where Cr is diffused into a Ti—Al alloy substrate, the substrate is subjected to a Cr-pack cementation process at a diffusion-treatment temperature of about 1300° C. or more.

Alternatively, a Cr layer is deposited on the substrate through an electroplating process, a thermal spraying process, a PVD process, a CVD process or a sputtering process, and then the deposited Cr is diff-used into the substrate in a high-temperature range providing a $\beta$ single phase. While the amount of Cr diffusion is set depending on the type of the substrate, it is preferably controlled in the range of about 150 to 250 g/m$^2$ in view of forming the inner layer 1 effective as a diffusion barrier.

For example, the Cr-pack cementation process may comprise the steps of polishing the surface of a Ti—Al alloy substrate using a water-resistant abrasive paper (# 1200), immersing the substrate in a mixed powder prepared by mixing a Cr powder and an $Al_2O_3$ powder in a weight ratio of 1:1, heating the alloy substrate up to a target temperature (about 1000 to 1400° C.) at a heating rate of about 10° C./min in a vacuum atmosphere (about $10^{-3}$ Pa), maintaining the target temperature for a given period of time (about 1 to 10 hours) to form a $\beta$ single phase, and then cooling the alloy substrate in a furnace (average cooling rate: about 10 to 20° C./min) to form the inner layer with three coexistent phases consisting of $\beta$, $\gamma$ and Laves phases. The cooling step may include a step of holding the temperature of the alloy substrate at about 1000 to 1200° C. for a given period of time (about 1 to 100 hours) and then re-cooling the alloy substrate.

Phases to be precipitated during the cooling step can be estimate by actually measuring or theoretically calculating the respective concentration distributions of Ti, Al and Cr in a high-temperature region corresponding to the $\beta$ single-phase region. The structure, such as size, and the type of phase to be precipitated can also be controlled by combining the conditions of the cooling rate in the cooling step and the heat treatment to be performed at a constant temperature during the cooling step. The structural control can provide enhanced strength of the Cr diffusion layer.

Generally, when an outer layer with a high Al concentration is formed directly on the surface of a base, the thermal stress to be generated between the outer layer and the base has a large value to the extent of causing the destruction of the surface layer. However, such cracks of the outer layer can be suppressed by forming the inner layer between the outer layer and the base while providing enhanced strength to the inner layer through the structural control as described above.

After the inner layer is formed on the base 3, the alloy substrate is subjected to an Al diffusion treatment. The Al diffusion treatment is preferably performed through an Al-pack cementation process in which the alloy substrate is immersed in an Al-containing powder, and then heated at a high temperature. Alternatively, the Al diffusion treatment may be performed by depositing an Al layer on the alloy substrate through an electroplating process using a molten-salt bath or a nonaqueous bath, a PVD process, a CVD process or a sputtering process, and then subjecting the alloy substrate to a heating treatment to diffuse the deposited Al into the alloy substrate.

The Al-pack cementation process may comprise the steps of immersing the alloy substrate in a mixed powder prepared by mixing a $TiAl_3$ powder and an $Al_2O_3$ powder, and heating the alloy substrate up to a temperature of about 1300 to 1400° C. in a vacuum atmosphere for about 1 to 10 hours. In the above method of diffusing Al through a heating treatment after the deposition of an Al layer, the alloy substrate with the deposited Al layer may be stepwise heated up to a temperature of about 1300 to 1400° C., and then maintained at the temperature for about 1 to 10 hours.

When the Al diffusion treatment is performed at a temperature of about 1300° C. or more, the three-phase layer formed through the Cr diffusion treatment is transformed to a $\beta$ single phase. This allows Al to be diffused into the $\beta$ single phase. Then, during a cooling process, the three-phase layer (inner layer 1) is re-formed. Concurrently, a $\tau$ phase of $TiAl_2$ or Ti (Al, Cr)$_3$ is formed during the cooling process in the surface-side region of the surface layer having a high Al concentration to provide the outer surface 2. In addition, a mixed layer of the inner and outer layers 1, 2 exists therebetween.

In the Al diffusion treatment performed at a temperature of about 1300° C. or more, the inner layer transformed to the $\beta$ single phase can facilitate the diffusion of Al to allow the surface layer to have a thickness of 1 mm or more. Then, the three-phase layer (inner layer 1) is re-formed during the cooling process. That is, the inner layer formed through the Cr diffusion treatment is vanished once.

In the Al diffusion treatment performed at a temperature of about 1200° C. or less, the three-phase layer formed through the Cr diffusion treatment is not transformed at about 1200° C. but left just as it is. Thus, the three-phase layer acts as a diffusion barrier to reduce the diffusion depth or distance of Al. This means the need to perform the Al diffusion treatment for an extended period of time. On the other hand, the maintained three-phase layer formed through the Cr diffusion treatment can eliminate the need for any heat treatment after the Al diffusion treatment. In addition, it can be expected to have enhanced smoothness in the surface of an obtained heat-resistant Ti alloy material. A high-activity Al diffusion treatment is effective to facilitate the diffusive penetration of Al at a temperature of about 1200° C. or less.

Specifically, as mentioned above, the Cr diffusion treatment is first performed at a temperature of about 1300° C. or more within the β single-phase region, and then γ and Laves phases are precipitated during the cooling process. Subsequently, the high-activity Al diffusion treatment is preferably performed at a temperature of about 1200° C. or less.

The amount of Al diffusion is preferably set to allow an outer layer 2 to be formed with an Al concentration of about 50 atomic % or more. If the Al concentration of the outer layer 2 is assured preferably at about 50 atomic % or more, more preferably at about 60 atomic % or more, an $Al_2O_3$ film exhibiting excellent high-temperature resistance and oxidation resistance will be formed on the surface of the outer layer 2. Even if the $Al_2O_3$ film is damaged under use conditions, Al will be supplied from the outer layer 2 with a high Al concentration to form $Al_2O_3$ and self-repaire the damaged portion of the film. In addition, the inner layer 1 acts to suppress the diffusion of Al from the outer layer 2 to the base 3 so as to maintain the Al concentration of the outer layer 2 at a high value. Thus, the heat-resistant Ti alloy base can be protected from high-temperature corrosion and/or abnormal oxidation to allow excellent characteristics inherent in the heat-resistant Ti alloy to be effectively utilized.

In this connection, a lower limit of the Al concentration required for the surface of a substrate to self-repair the protective $Al_2O_3$ film is varied depending on the type of the substrate. For example, the lower limit is about 20 atomic % for a Ni—Al alloy substrate, about 10 atomic % for a Ni—Cr—Al alloy substrate, and 50 atomic % for a Ti—Al alloy substrate. In either case, the inner layer 1 interposed between the outer layer 2 and the base 3 to serve as a diffusion barrier layer allows the Al concentration of the outer layer 2 to be maintained at the lower limit or more.

The protective layer with the multilayer structure including the inner and outer layers 1, 2 may be formed by co-diffusing or simultaneously diffusing Cr and Al. As an example of this case, an Al—Cr alloy plated layer containing about 35 to 95 atomic % of Cr is first deposited on the surface of a heat-resistant Ti alloy substrate through an electroplating process at a current density of about 0.01 to 0.05 mA using an aluminum molten-salt bath containing about 0.01 to 2.0 mass % of Cr added thereto. Then, the heat-resistant Ti alloy substrate is stepwise heated up to a temperature for Cr diffusion, and maintained at the temperature for about 1 to 10 hrs.

In the above case of plating the Al—Cr alloy layer, a suitable heating temperature for Cr diffusion is in the range of about 800 to 1200° C. If the temperature is about 1300° C. or more, an inner layer formed during the course of the Cr diffusion will be vanished and transformed to a β phase to facilitate the diffusion of Cr and Al. This is advantageous in forming a thick surface layer. If the temperature is about 1200° C. or less, the inner layer will be maintained as-is, and an outer layer of Cr—Al—Ti will be formed on the surface of the inner layer. This is advantageous in accurately forming a thin surface layer.

EXAMPLE

Example 1

An Al alloy containing 50 atomic % of Ti was used as a substrate. The substrate was immersed in a mixed powder of Cr and $Al_2O_3$, and heated at about 1300° C. under a vacuum atmosphere for 5 hours to diffuse Cr at a rate of about 250 $g/m^2$. The diffused Cr exhibited a β phase. Then, the substrate was cooled in a furnace (average cooling rate: about 10 to 20° C./min) to separate three phases of β, γ and Laves phases from the β phase of Cr so as to form a three-phase layer (inner layer 1) having a thickness of about 300 μm. The heat-resistant Ti alloy substrate formed with the three-phase layer was then immersed in a mixed powder of $TiAl_3$ and $Al_2O_3$, and heated at about 1300° C. under a vacuum atmosphere for about 10 hours to diffuse Al at a rate of about 400 $g/m^2$. Consequently, an outer layer 2 having an average thickness of about 100 μm was formed on the inner layer 1.

Figure 1B:
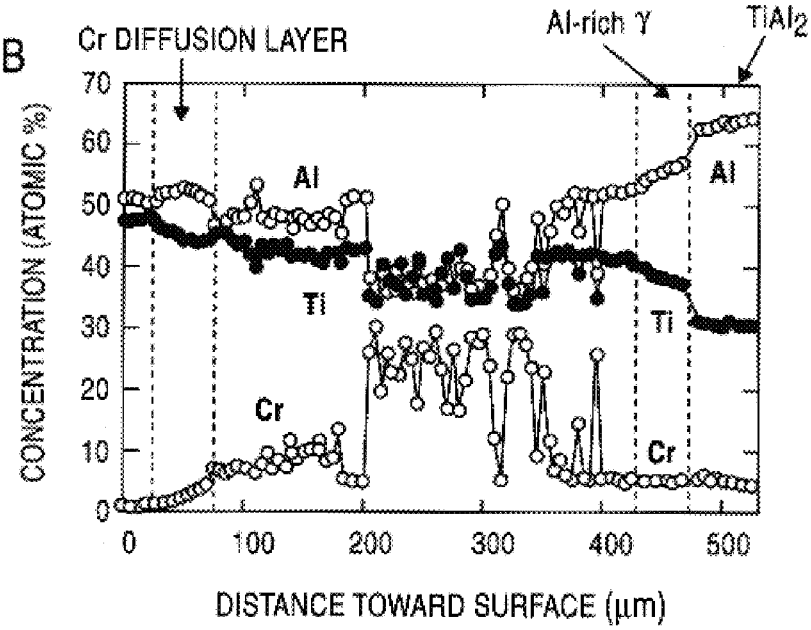
FIG. 1*b* is a graph showing the respective concentration distributions of the elements of the heat-resistant Ti alloy material in FIG. 1 along the thickness direction of the surface region.

In the sectional observation of a surface region of the obtained Ti—Al alloy material using an electron probe microanalyzer (EPMA), a three-phase layer (inner layer 1) with β, γ and Laves phases on the surface of a base 3 and an outer layer 2 with a high Al concentration was detected (FIG. 1*a*). The inner layer 1 had an average thickness of about 400 μm, and the outer layer 2 had an average thickness of about 100 μm. A Cr diffusion layer having an average thickness of about 50 μm was created in the surface of the base 3 in contact with the inner layer 1. In the analysis of the surface region of the Ti—Al alloy material using EPMA, the concentration of Ti was gradually lowered in a direction from the base 3 toward the outer layer 2. Further, the inner layer had the lowest concentration of Al and the highest concentration of Cr (FIG. 1*b*). This concentration distribution shows that the diffusion of Al between the base 3 and the outer layer 2 is suppressed by the inner layer 1.

Figure 2A:
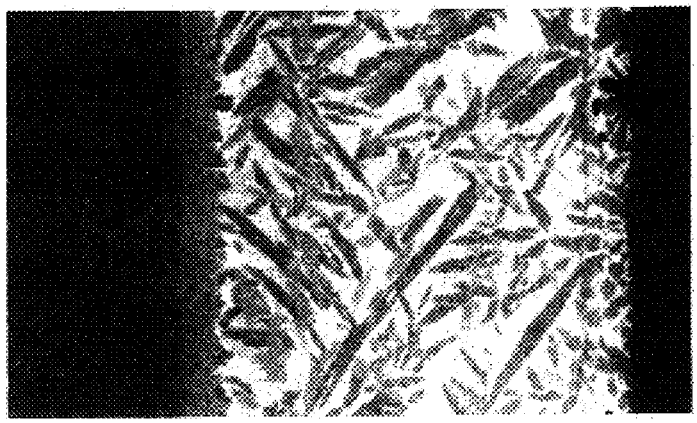
FIG. 2*a* is a metallographic micrograph showing the section of a surface region of a heat-resistant Ti alloy material in which the inner layer 1 and the out layer 2 are not clearly formed.
Figure 2B:
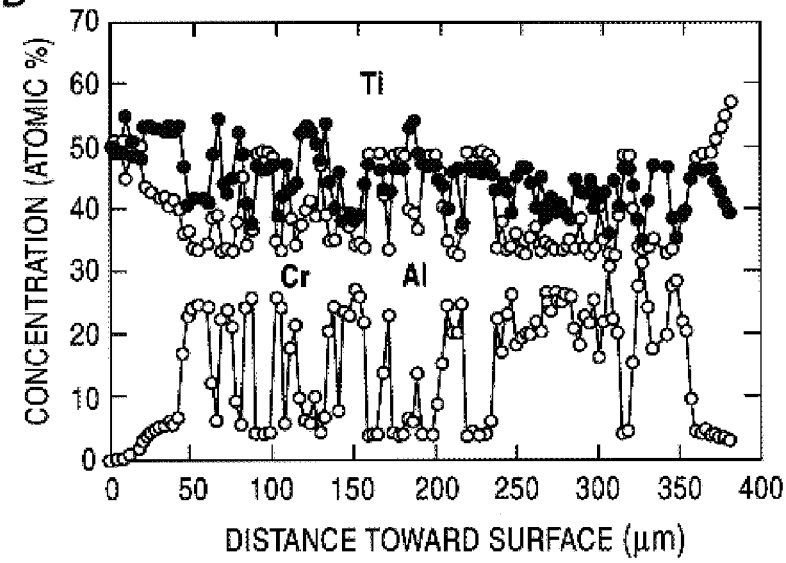
FIG. 2*b* is a graph showing the respective concentration distributions of the elements of the heat-resistant Ti alloy material in FIG. 2*a* along the thickness direction of the surface region.

The protective layer with the multilayer structure including the inner and outer layer 1, 2 can be effectively formed by diffusing Al in high activity at a high temperature of greater than about 1200° C. The high-temperature diffusion treatment can provide a three-phase layer (inner layer 1) with a relatively low Al concentration and an outer layer 2 with a high Al concentration. For example, in case of diffusing Al at about 1000° C., an outer layer 2 was not formed with an intended high Al concentration, and a three-phase layer or inner layer 1 was not clearly formed (FIG. 2*a*). As seen in FIG. 2*b* showing respective concentration distributions of the elements in a surface region of this Ti—Al alloy material in the thickness direction, any inner layer 1 with a relatively low Al concentration was not detected.

Figure 3:
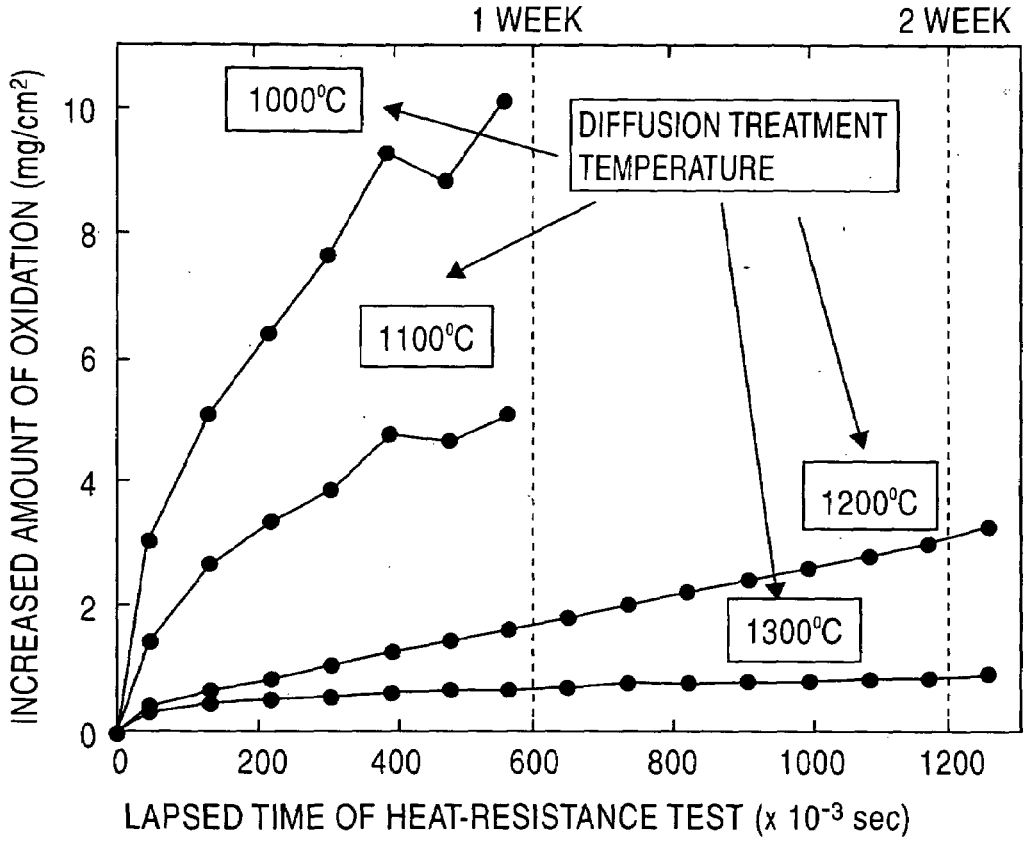
FIG. 3 is a graph showing the increased amount of oxidation in a heat-resistant Ti alloy material in relation to a temperature for an Al diffusion treatment.

The Ti—Al alloy material formed with the protective layer was subjected to an oxidation-resistance or heat-resistance test to measure the increased amount of oxidation. In the heat-resistance test, the Ti—Al alloy material was heated up to about 900° C. (heating rate: about 10° C./min) under a normal atmosphere, and maintained at the temperature for about 24 hours. Then, the Ti—Al alloy material was cooled to a room temperature (average cooling rate: about 15° C./min), and maintained at the temperature for about 2 to 10 hours. These heating and cooling processes were repeatedly performed. While all samples had a tendency to have a larger increased amount of oxidation in proportion to the lapsed time of the heat-resistance test, inventive samples with a protective layer formed through an Al diffusion treatment performed at a high temperature of greater than about 1200° C. had just a slight increased amount of oxidation (FIG. 3). In contrast, comparative samples each subjected to an Al diffusion treatment at a relatively low temperature exhibited a sharper incremental gradient in the increased amount of oxidation as the temperature for Al diffusion becomes lower.

Figure 4A:
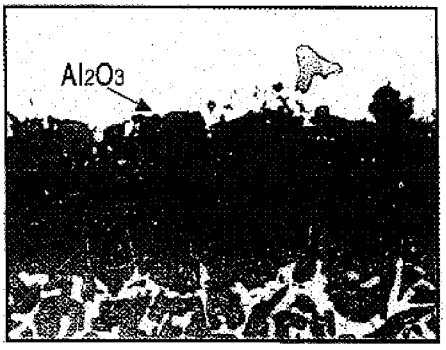
FIGS. 4*a* and 4*b* are metallographic micrographs showing the section of a surface region of a heat-resistant Ti alloy material after it is subjected to an Al diffusion treatment at temperatures allowing an outer layer 2 with a high Al concentration to be formed, and then to a heat-resistance test for about 348 hours.
Figure 4B:
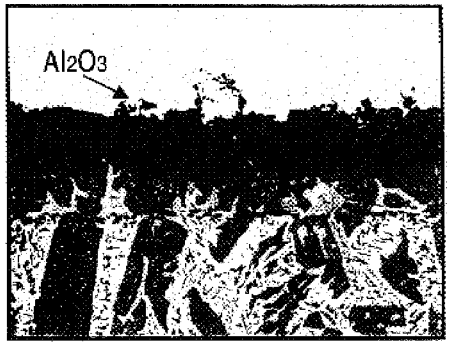
Figure 5A:
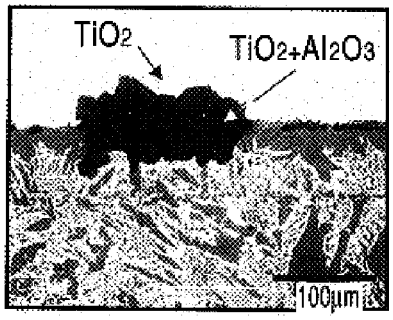
FIGS. 5*a* and 5*b* are metallographic micrographs showing the section of a surface region of a heat-resistant Ti alloy material after it is subjected to an Al diffusion treatment at relatively low temperatures and then to a heat-resistance test for about 156 hours.
Figure 5B:
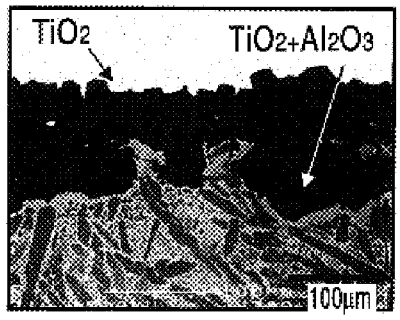

After the oxidation-resistance test continued for about 348 hours, the respective surface regions of the Ti—Al alloy materials were observed. In the inventive samples subjected to the Al diffusion treatment at about 1300° C. and about 1200° C., a protective $Al_2O_3$ film was detected on the surface of each of the inventive samples. This verifies that an outer layer 2 in each of the inventive samples has an adequately maintained function as an Al source (FIGS. 4*a* and 4*b*). In the comparative samples subjected to the Al diffusion treatment at relatively low temperatures of about 1100° C. and about 1000° C., $TiO_2$ was detected on the surface of each of the comparative samples at the time the oxidation-resistance test was performed for about 156 hours. This shows that an inner layer 1 in each of the comparative samples has an insufficient function as a diffusion barrier layer (FIGS. 5*a* and 5*b*).

INDUSTRIAL APPLICABILITY

As mentioned above, the heat-resistant Ti alloy material of the present invention has a protective surface layer with a multilayered structure including an inner layer which has three coexistent phases consisting of β, γ and Laves phases in the phase diagram of a Ti—Al—Cr based alloy, and an outer layer with a high Al concentration.

The inner layer serves as a diffusion barrier layer for preventing the diffusion of Al from the outer layer to a base and the diffusion of the elements of the base to maintain the Al concentration of the outer layer at a high value required for forming a protective $Al_2O_3$ film.

Thus, even if the outer layer is damaged under use conditions, Al supplied from the outer layer allows the defective portion of the $Al_2O_3$ film to be self-repaired so as to prevent high-temperature corrosion and/or abnormal oxidation of the heat-resistant Ti alloy base. In this manner, the heat-resistant Ti alloy material formed with the protective layer can exhibit excellent high temperature characteristics inherent in the heat-resistant Ti alloy to achieve excellent durability as structural members and machine components to be exposed to high temperature atmospheres.

What is claimed is:

1. A heat-resistant Ti alloy material excellent in high-temperature corrosion resistance and oxidation resistance, comprising:

a base made of a heat-resistant Ti alloy; and a surface layer formed on the surface of said base, said surface layer having a multilayer structure which includes an inner layer and an outer layer, said inner layer having three coexistent phases consisting of a β phase, a γ phase and a Laves phase in the phase diagram of a Ti—Al—Cr based alloy, said outer layer being made of an Al—Ti—Cr based alloy having an Al concentration of 50 atomic % or more.

2. The heat-resistant Ti alloy material as defined in claim 1, wherein said outer layer includes at least one phase selected from the group consisting of a Ti $(Al, Cr)_3$ phase, a Ti $(Al, Cr)_2$ phase and a τ phase.

3. The heat-resistant Ti alloy material as defined in claim 2, which includes a Cr diffusion layer interposed between said base and said inner layer.

4. A method for producing the heat-resistant Ti alloy material, comprising:

subjecting a substrate made of a heat-resistant Ti alloy to a Cr diffusion treatment to diffuse chromium into said substrate at a temperature within a β single-phase region in the phase diagram of a Ti—Al—Cr based alloy;

precipitating a γ phase and a Laves phase from the β phase during a cooling process to form the inner layer with three coexistent phases consisting of the β, γ and Laves phases; and then subjecting said obtained product to an Al diffusion treatment to diffuse aluminum into said product so as to form the outer layer of an Al—Ti—Cr based alloy having an Al concentration of 50 atomic % or more.

5. The method as defined in claim 4, which includes performing a heat treatment during said cooling process.

6. The method as defined in claim 4, wherein said Cr diffusion treatment is performed at a temperature of 1300° C. or more within the β single-phase region, and said Al diffusion treatment is performed at a temperature of 1200° C. or less.

* * * * *